US007832040B2

(12) United States Patent
Constantinescu et al.

(10) Patent No.: US 7,832,040 B2
(45) Date of Patent: Nov. 16, 2010

(54) SUSPENDED FLEXIBLE MATRIX SUPPORT SYSTEM

(75) Inventors: Eugen Constantinescu, Greensboro, NC (US); Bernhard W. Kuchel, King, NC (US)

(73) Assignee: Sealy Technology LLC, Trinity, NC (US)

( * ) Notice: Subject to any disclaimer, the term of this patent is extended or adjusted under 35 U.S.C. 154(b) by 305 days.

(21) Appl. No.: 11/657,318

(22) Filed: Jan. 24, 2007

(65) Prior Publication Data

US 2008/0172799 A1 Jul. 24, 2008

(51) Int. Cl.
*A47C 17/00* (2006.01)

(52) U.S. Cl. ..... 5/740; 5/236.1; 5/239; 5/241

(58) Field of Classification Search ..... 5/236.1, 5/239, 241, 244, 740
See application file for complete search history.

(56) References Cited

U.S. PATENT DOCUMENTS 3,935,605 A 2/1976 Hutchinson
3,967,331 A 7/1976 Glassman
4,012,802 A 3/1977 Hutchinson
4,129,908 A * 12/1978 Wagner ..... 5/35
4,535,494 A 8/1985 Diamonstein
5,058,223 A 10/1991 Vasquez
5,210,890 A * 5/1993 Hagglund ..... 5/239
5,280,658 A * 1/1994 Sigl ..... 5/236.1
5,588,165 A 12/1996 Fromme
6,108,834 A 8/2000 Mauro et al.
6,637,053 B1 * 10/2003 DiNapoli et al. ..... 5/236.1
6,651,276 B2 11/2003 McCraw
6,678,905 B2 1/2004 Ling et al.
6,948,199 B2 9/2005 Hooper, Jr.

* cited by examiner

*Primary Examiner*—Fredrick Conley
(74) *Attorney, Agent, or Firm*—James C. Scott; Roetzel & Andress

(57) ABSTRACT

A suspended matrix support structure has a perimeter frame which supports a flexible matrix formed with intersecting flexible members, the ends of which are supported by the perimeter frame. Edges of the flexible members are held within channels which form a frame about the flexible matrix. In one embodiment, the perimeter frame is constructed of foam with contoured features which support the frame of the flexible matrix. The flexible members of the flexible matrix extend across the expanse within the perimeter frame to provide a flexible support structure which can be used as a mattress, mattress foundation or both in combination.

26 Claims, 6 Drawing Sheets

SUSPENDED FLEXIBLE MATRIX SUPPORT SYSTEM

FIELD OF THE INVENTION

The disclosure is in the general field of support structures, including flexible support structures.

BACKGROUND OF THE INVENTION

Mattresses, and foundations (or "box springs") for supporting sleeping mattresses have traditionally been constructed with the basic materials of textiles, including natural and synthetic materials for padding and comfort, and wood and steel components for structural support. For foundations, wood is used to construct the frame which supports an array of steel wire springs which elevate a grid or deck above the frame to form a reflexive support surface. The grid is also commonly made of steel wire which is welded or clipped together. Conventional mattresses use a wire form innerspring, made up of hundreds of helical or other shaped coils which are interconnected by wire or fabric. Layers of padding are positioned over the support ends of the springs of the innerspring, and the innerspring and padding is encapsulated with upholstery.

These basic constructions have now been in use for well over one hundred years, and although economical and practical, do not exploit the properties of modern materials which are advantageous for use in flexible support structures including bedding. The large number of components and required manual assembly increases to the cost of these conventional designs.

SUMMARY OF THE INVENTION

The present invention is a new type of flexible support system which utilizes a suspended flexible matrix. The flexible support system can be configured and used as a mattress or mattress foundation of any size. In one embodiment, a suspended flexible matrix support system is formed by a matrix of flexible members which are supported by a frame located at a perimeter of the flexible matrix. In one form, the frame is made of foam, such as extruded or molded or sculpted foam, configured to elevate a perimeter of the flexible matrix. Ends of the flexible members of the matrix may be capped or covered by channels which also contact a supporting surface of the frame. In one exemplary embodiment, the flexible matrix is suspended by a shelf structure formed at an interior perimeter of the frame, which elevates the flexible matrix above a surface or other support structure on which the frame rests. Because the frame is constructed of compressible and resilient foam material, the frame provides reflexive support in addition to the flexible matrix. The flexible members of the flexible matrix may be arranged both longitudinally and transversely with respect to the frame, and may be bonded together or fastened at interesting regions or points, or not. The configuration of the frame, including the cross-sectional shape of the frame members and the shape of the perimeter of the frame, may be varied by design. The height of the frame, and the height at which the frame supports or elevates the flexible matrix may also be varied by design. The material of the frame may also be varied according to desired characteristics. A preferred material is foam, and in particular extruded foam. The type and density of the foam can also be varied. Other representative materials for the frame include any type of engineered plastics made of entirely synthetic materials or combinations of synthetic and organic materials. The frame members may also perform other structural functions such as for attachment of other components of a bed or other support structure, such as legs, internal material layers and upholstery. Cavities may also be formed in the frame members to accommodate or house other components, sensors or electronics which are part of a flexible support system, and which also may be incorporated or integrated into the flexible matrix.

These and other aspects of the invention are further described herein as representative embodiments of the principles and concepts of the invention, as ultimately defined by the claims and not by the foregoing Summary of the Invention.

DETAILED DESCRIPTION OF PREFERRED AND ALTERNATE EMBODIMENTS

Figure 1:
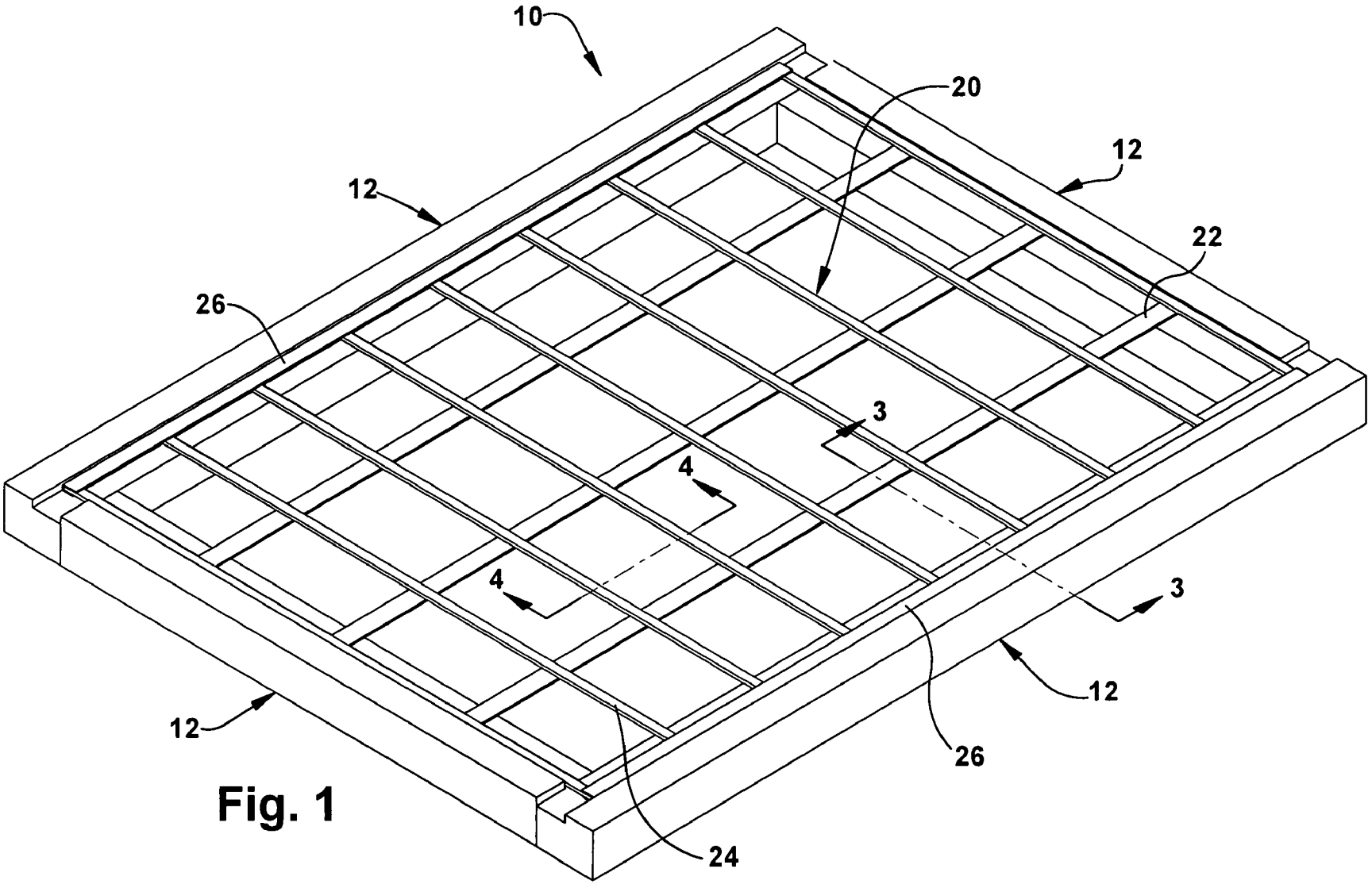
FIG. 1 is a perspective view of one embodiment of a suspended flexible matrix support system of the invention.

FIG. 1 illustrates one embodiment of a suspended flexible matrix support system, indicated generally at 10. Frame members 12 are arranged to define a perimeter of the support system 10, for example in the form of a rectangle when configured for use as a sleep support surface, as further described. The frame defined by frame members 12 supports a flexible matrix 20 (also referred to herein as "matrix") which serves as a flexible support underlying a flexible support surface, such as a body support surface of a mattress of piece of furniture. The system 10 is configurable to a frame perimeter of any shape. As further shown in FIGS. 3 and 6, the frame members 12 in one form have a generally rectangular cross-sectional shape, with an outer vertical side surface 121 which defines a vertical side of the frame, and a generally flat bottom surface 122. A shelf 123 is formed in an upper region of the frame member, proximate to an upper surface 124 which intersects with the vertical side surface 121. The shelf 123 has a surface area which is configured to support a perimeter of a flexible matrix 20. The shelf 123 can be considered as part of or a feature of the upper surface 124 of the frame members. When the perimeter of the flexible matrix 20 rests on the shelf 123, the upper surface 124 is substantially flush with the flexible matrix 20 and forms a perimeter to the horizontal support platform of the flexible matrix 20. This particular configuration of a frame member 12 is representative, and other configurations which perform the described functions are within the scope of the invention. For example, the frame member 12 do not have to include a distinct shelf 123 in order to support or elevate or suspend the flexible matrix 20, as further described. The frame members 12 are abutted together at the corners of the frame 12 and can be mechanically attached by bonding such as thermal bonding (welding), adhesive, or by mechanical attachment by fasteners which engage abutting frame members directly. Alternatively, the frame members 12 may be held in position about the flexible matrix 20 by external components such as sheet material, padding P and upholstery U as shown in FIG. 7.

The frame members 12 can be made in any length to create any size or shape support surface, including any of the different conventional sizes of mattresses and mattress foundations. In one form, the frame members 12 are made of extruded foam, such as polyethylene which is extruded through a die with the desired cross-section shape, and which upon expansion thereafter assumes the same cross-sectional shape of the die opening on a larger scale. By the extrusion process, the polyethylene material forms an outer skin about the cross-section which surrounds the closed cells which form in the interior. The skin is thicker than the walls of the closed cells, and serves to hold the cross-sectional shape of the extruded part. The closed-cell geometric foam structure which is thus formed has excellent compressible and resilient support characteristics, and enough structural rigidity (from the combination of the closed cells and outer skin) to serve as a support structure, such as to elevate and support and suspend a flexible matrix as a support surface. The frame members 12 are thus compressible under loads applied directly or by the flexible matrix 20, and resilient, meaning that they return to the uncompressed configuration when applied loads are removed.

Given the excellent support characteristics of the frame members 12 when fabricated in this manner, the extent to which the frame members 12 may underlie the flexible matrix 20, e.g. the width of shelf 123, can be varied by design. For example, the height of the frame member 12 and resulting elevation of the shelf 123 on which edges of the flexible matrix 20 rests can be specified according to the overall design height and width of the flexible matrix support system 10.

The flexible matrix 20 is, in one representative form, made from intersecting elongate flexible members (also referred to herein as "flexible members") 22 and 24 of any suitable flexible material. Flexible members 22 are arranged parallel in a first direction, such as longitudinally, aligned with the length of frame 12. In this arrangement the flexible members 22 are also referred to as "longitudinal members". Flexible members 24 are arranged generally transversely and perpendicular to members 22 and span across a width of frame 12. In this arrangement the flexible members 24 are also referred to as "transverse members". The arrangement and intersection of the flexible members 22 and 24 does not have to be orthogonal as shown, but may be in any manner which creates a flexible support matrix capable of supporting additional materials and different types and sizes of loads. The flexible members 22, 24 are also alternatively referred to as either the "first group" or "second group" of flexible members.

The flexible members 22, 24 can be made of any type of material which provides adequate strength and a desired degree of flexibility, primarily in the vertical dimension, normal to the plane in which the flexible matrix 20 lies in an unloaded state. A general design criteria is that deflection of the matrix 20 at any one point when under a load not exceed the elevation of the matrix 20 above the bottom surface 122 of the frame members 12. In the embodiment shown, the flexible members 22 are underlying flexible members 24. In this case, the stiffness or bending modulus of the underlying flexible members 22 can be designed to be greater than that of overlying flexible members 24 in order to augment the overall stiffness of the flexible matrix 20. Alternatively, the stiffness or bending modulus of any of the flexible members of the flexible matrix 20 can be designed or selected to tune the flexibility of the matrix 20 in any particular region.

In one form, the flexible members 22, 24 can be made as molded parts or pultrusions of any suitable polymeric material, including but not limited to the classes of polypropylene, polyethylene, nylon or ABS and with fiber reinforcement. For example, glass or synthetic fibers may be integrated with epoxy or vinyl or polyesters, high density plastic such as polyethylene, high density plastic foam, encapsulated steel or steel alloys, or any other materials and combinations of materials which have the desired flex modulus and cycle strength when formed in the described shapes of the flexible members 22, 24. When made of fiber-reinforced composite material, the flexible members may be compound molded or compression molded into the elongate shapes, or by a pultrusion process, wherein continuous strands of fiber such as fiberglass or other material (which may constitute anywhere from 20% to 80% of the volume of the finished product) are saturated with a resin system by pulling through a vat of epoxy or vinyl ester. The combined materials are then compression molded into the desired shapes, such as any of the various described shapes of the flexible members 22, 24 and variations thereof.

Figure 3:
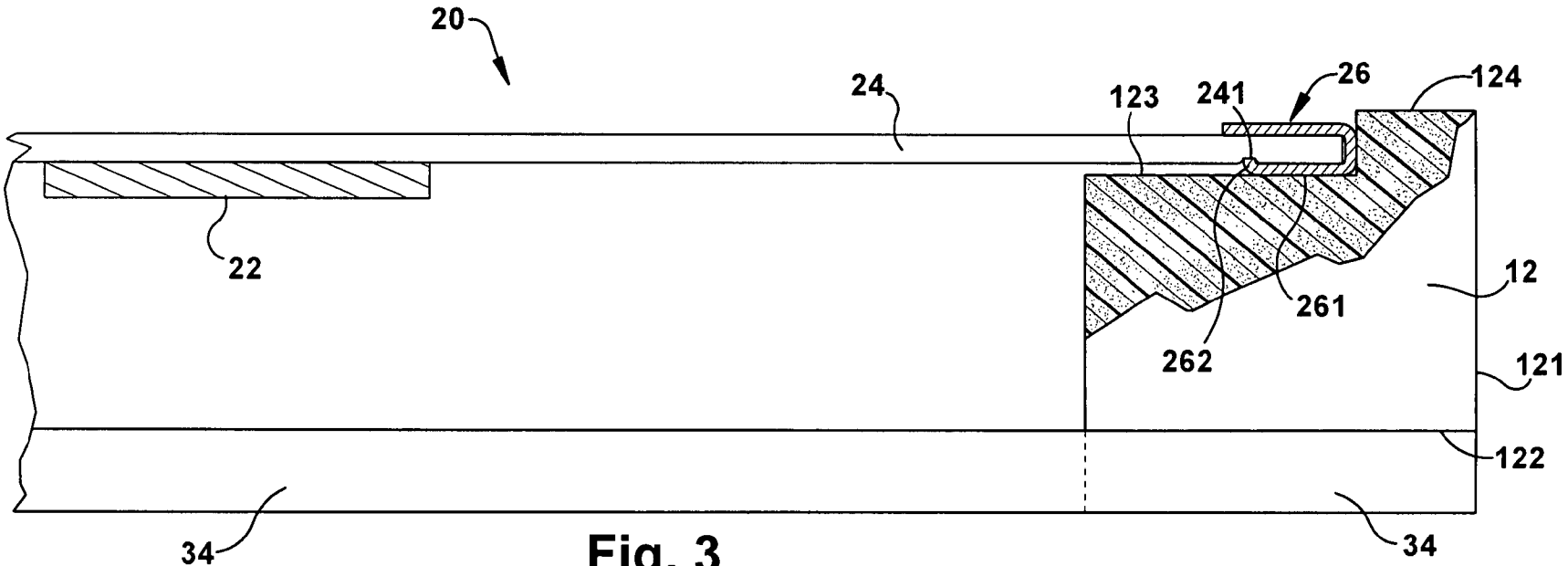
FIG. 3 is profile and partial cross-sectional view of the suspended flexible matrix support system of the invention shown in FIG. 1.

As shown in FIG. 3, additional optional components of the flexible matrix 20 are channels 26 which are engaged with the terminal ends of the transverse flexible members 24. The channels 26 provide additional rigidity at the perimeter of the flexible matrix 20 and provide an additional mounting or contact surface for the matrix upon the frame member shelf 123. The channels 26 also simplify construction of the flexible matrix 20, by for example snap-fit of an end 262 of lower leg 261 with a detent 241 formed proximate to the ends of flexible members 24. This insures proper alignment and registration of the flexible members 24 and avoids the need for additional fasteners or bonding between the flexible members 24 and channels 26. The use of channels 26 does not, however preclude the use of fasteners or bonding agents between the flexible members 22, 24, or between flexible members 22, 24 and channels 26. The channels 26 define a perimeter to the flexible matrix 20. The perimeter may be considered to be just the channels 26, or the channels 26 and the terminal regions of the flexible members 22, 23 which extend into the channels.

Figure 4:
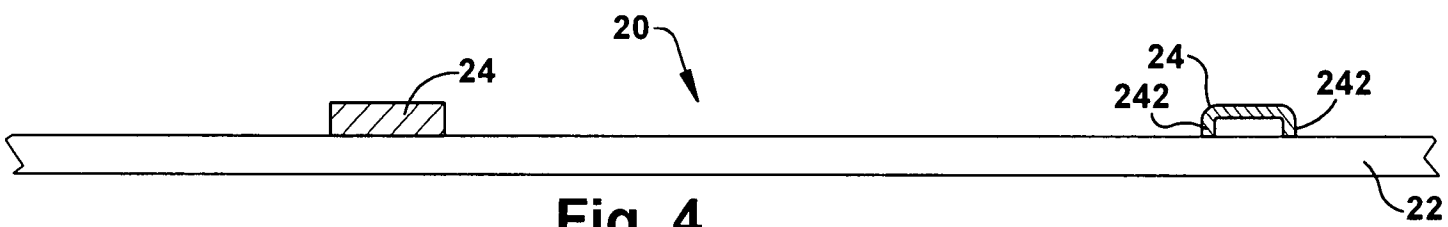
FIG. 4 is a profile and partial cross-sectional view of the flexible matrix portion of the suspended matrix flexible support system of the invention shown in FIG. 1.

As further shown in FIG. 4, the flexible members 22 and 24 may be bonded or fastened together at the respective intersections or not, depending upon the particular design parameters, intended use, and desired support characteristics. For example, with the flexible members 24 overlapping members 22 without any permanent connection there between, a low but constant static or dead load upon the matrix 20 such as from padding an upholstery will effectively dampen any relative motion, sliding or contact between the intersecting flexible members. As also illustrated, the intersecting flexible members may have different configurations and sizes. For example, the transversely disposed flexible members 24 may have a generally U-shaped cross-section with legs 242 oriented downward in contact with the upper surface of underlying flexible members 22, which have a generally rectangular cross-section as shown in FIG. 3. Of course other cross-sectional shapes and relative sizes are possible in combination to achieve desired stiffness and/or flex modulus of the members and overall resilience of the flexible matrix 20.

Figure 5:
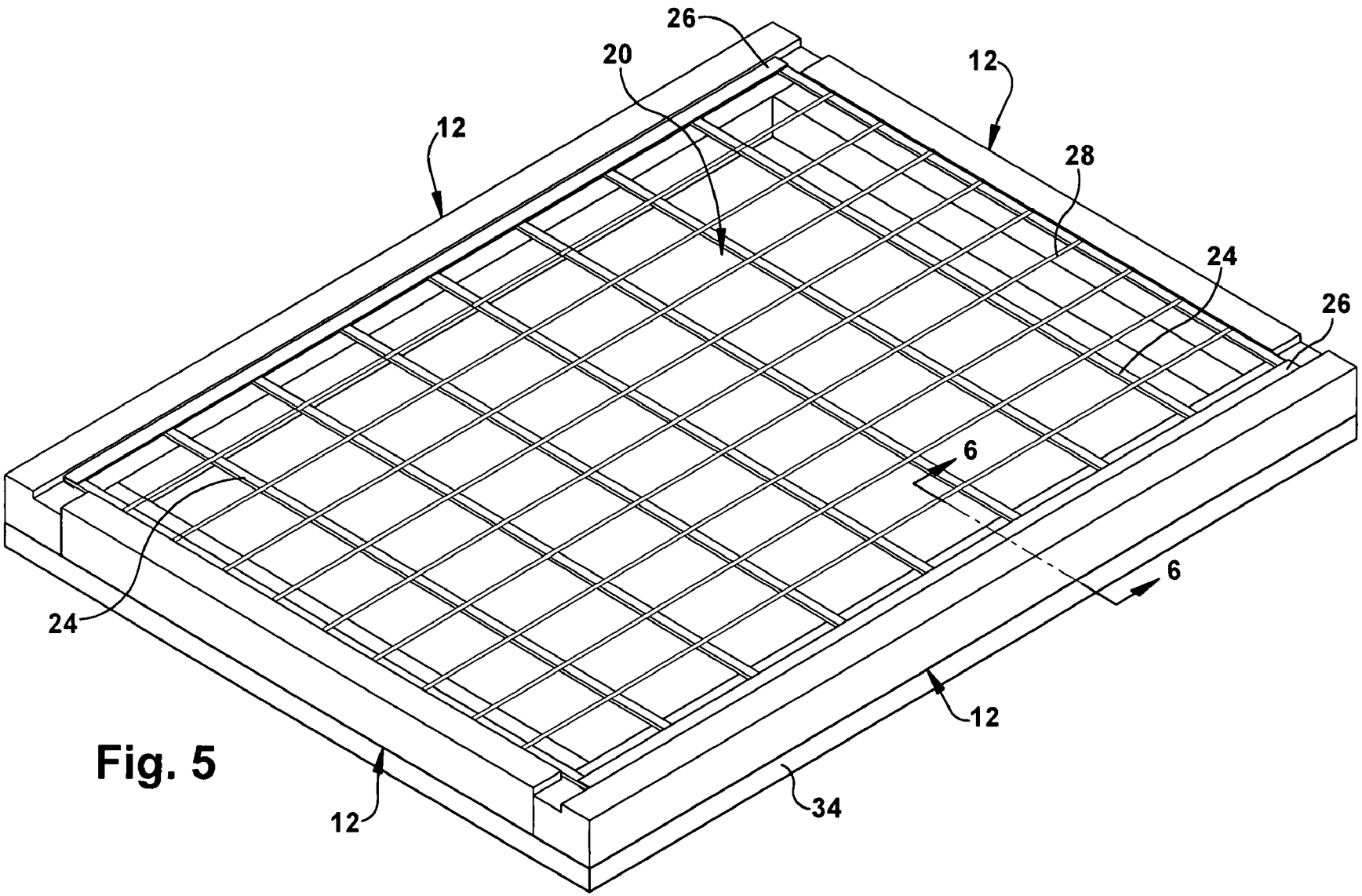
FIG. 5 is a perspective view of an alternate embodiment of a suspended flexible matrix support system of the invention.
Figure 6:
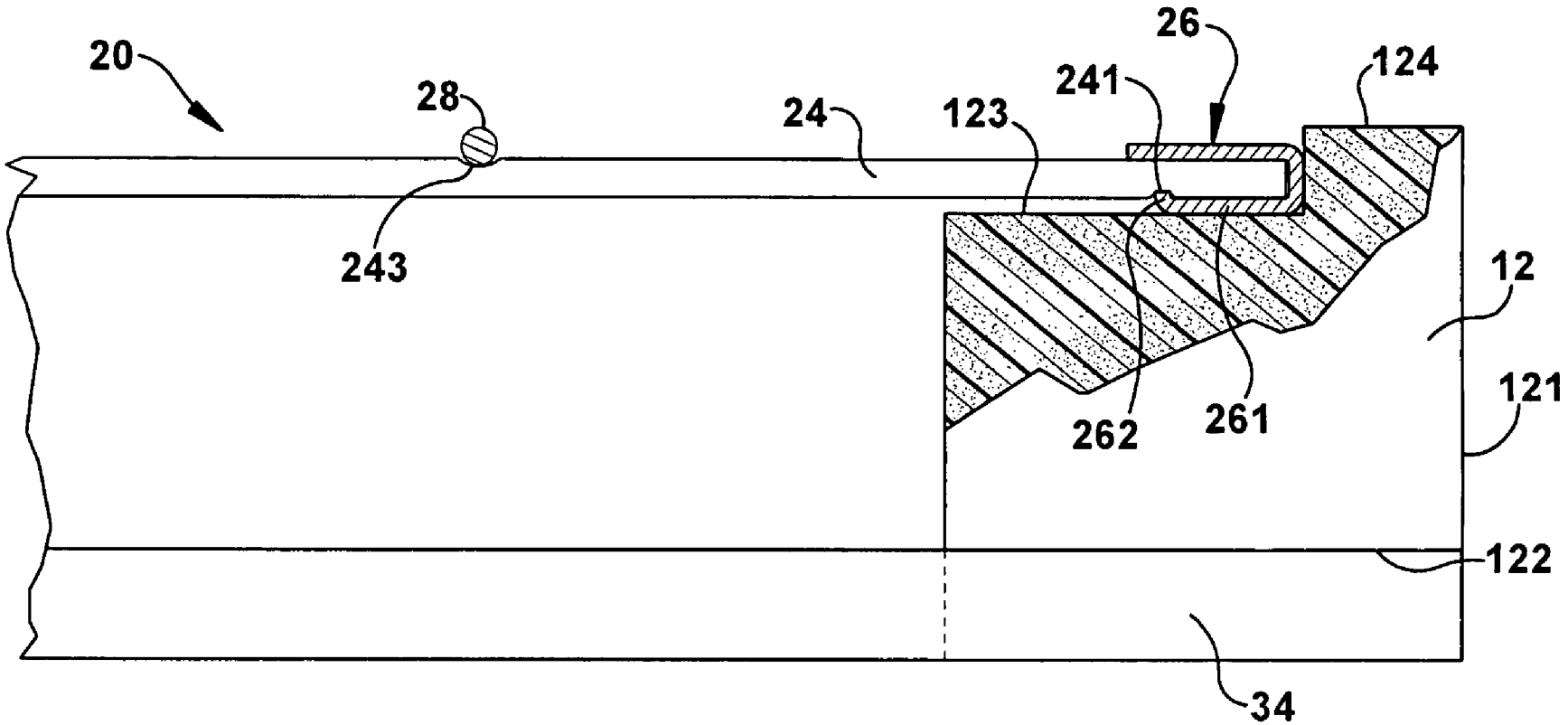
FIG. 6 is a profile and partial cross-sectional view of the suspended flexible matrix support system shown in FIG. 5, from the arrows 6-6 in FIG. 5.
Figure 7:
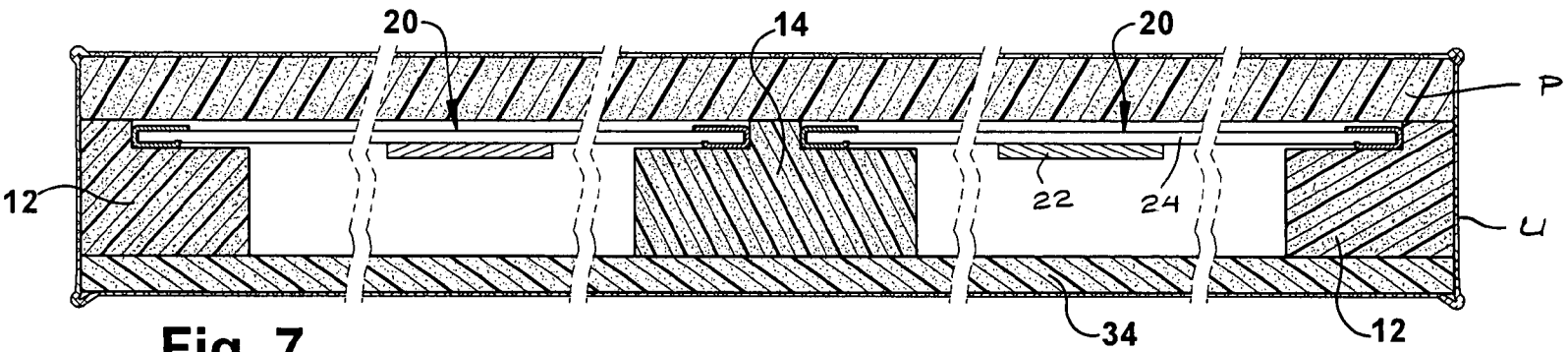
FIG. 7 is a cross-sectional view of a side-by-side version of a suspended flexible matrix support system shown in FIG. 8.

FIGS. 5 and 6 illustrate an alternate embodiment wherein the flexible matrix 20 includes flexible members 24 again arranged transverse to a length of the matrix 20 and spanning between the longitudinal frame members 12. Ends of the flexible members 24 are similarly captured or engaged with channels 26 as previously described. Flexible members 28 are arranged longitudinally on top surfaces of members 24 to complete the matrix 20. In this embodiment it is preferable that members 28 are secured to members 24 at the areas of overlapping intersection to structurally integrate the matrix 20, such as by adhesive bonding or fusing (welding) of material of the two members. Suitably shaped detents 243 may be formed in flexible members 24 to receive the intersecting and overlapping segments of flexible members 28 to further structurally integrate and strengthen the flexible matrix 20.

Figure 2:
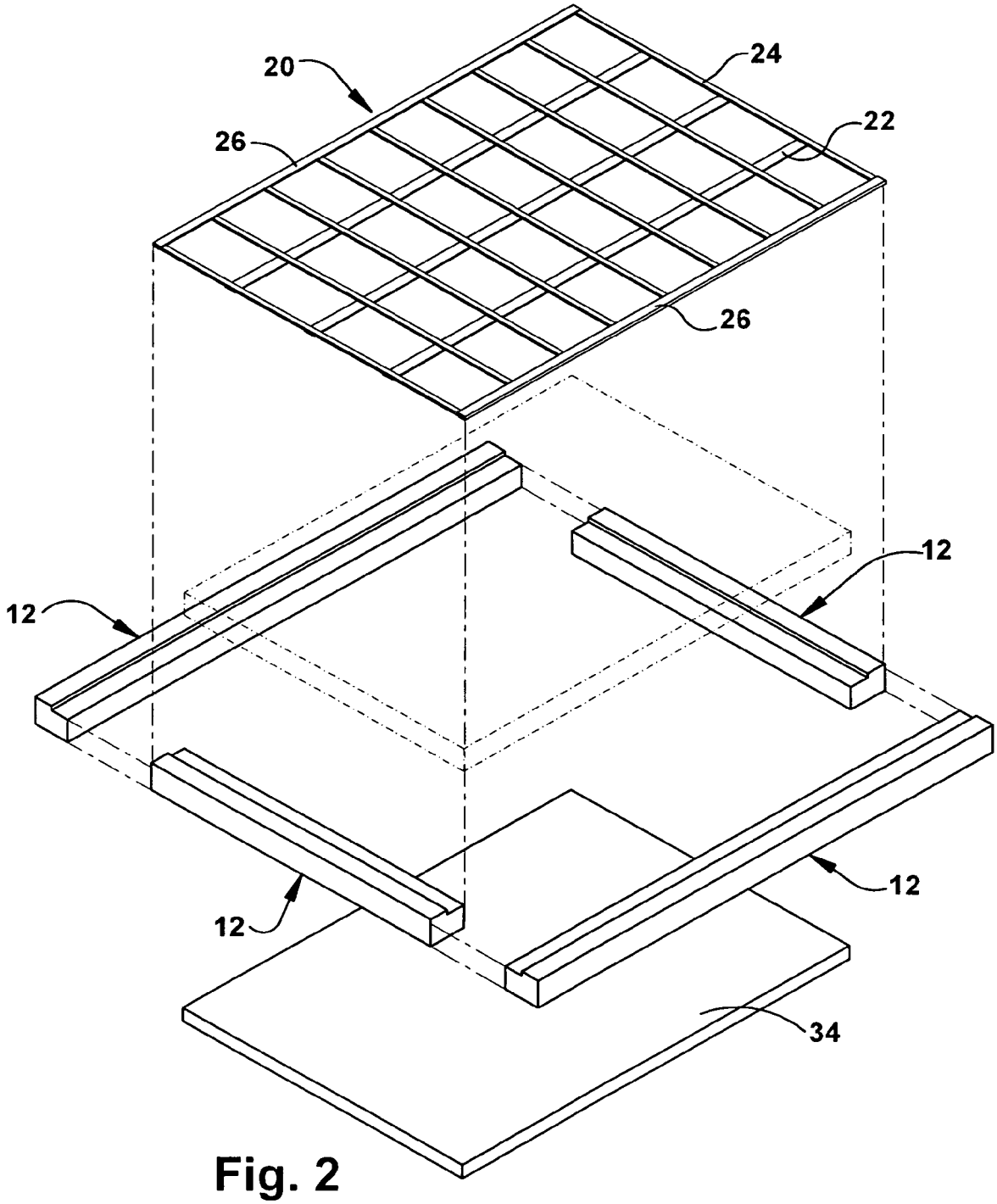
FIG. 2 is an exploded assembly view of a suspended flexible matrix support system of the invention.

One or more internal or external components 30 may be provided within frame 12 and above or below the flexible matrix 20, such as a foam pad within the perimeter defined by the frame members 12 and underneath the flexible matrix, as shown in phantom in FIG. 2. Examples of internal components include material layers, such as woven or synthetic sheet material which may be bonded or otherwise attached to the flexible matrix 20, and components with volume such as a foam block such as polyurethane or latex foam.

As shown in FIGS. 2, 3, 5 and 6-8, a foam deck 34, or other resilient material, is positioned underneath the frame members 12. The foam deck 34 can be made of the same type of foam as frame members 12, or of a different type and with a different density. Also, the foam deck 34 can be a single slab of foam material, or individual pieces which are glued or fused or welded together. The frame members 12 can be adhered, fused or welded to the foam deck 34 at the contacting bottom surface 122. Although shown in rectangular form, the foam deck 34 can be made in other shapes, including elongate strips which underlie only the frame members 12, as shown in the alternative in FIGS. 3, 6 and 8. As used herein, the term "foam deck" refers to any foam component, or a plurality of foam components, positioned underneath (under the bottom surface 122) or proximate to or bonded to the bottom surfaces of one or more of the frame members 12. Also, the material of the foam deck 34 may differ from the material of the frame members 12 and have different density or ILD values. In this way the reflexive and support properties and characteristics of the frame and foam deck components of the support system can be tuned as desired in combination with the flexible matrix 20.

External components include exterior layers of padding or cushioning, "active layers" such as air or water chambers or bladders, sensors such as in the form of smart cloth or other instrumented materials or devices, heating or cooling elements, and insulating and upholstery materials.

Figure 8:
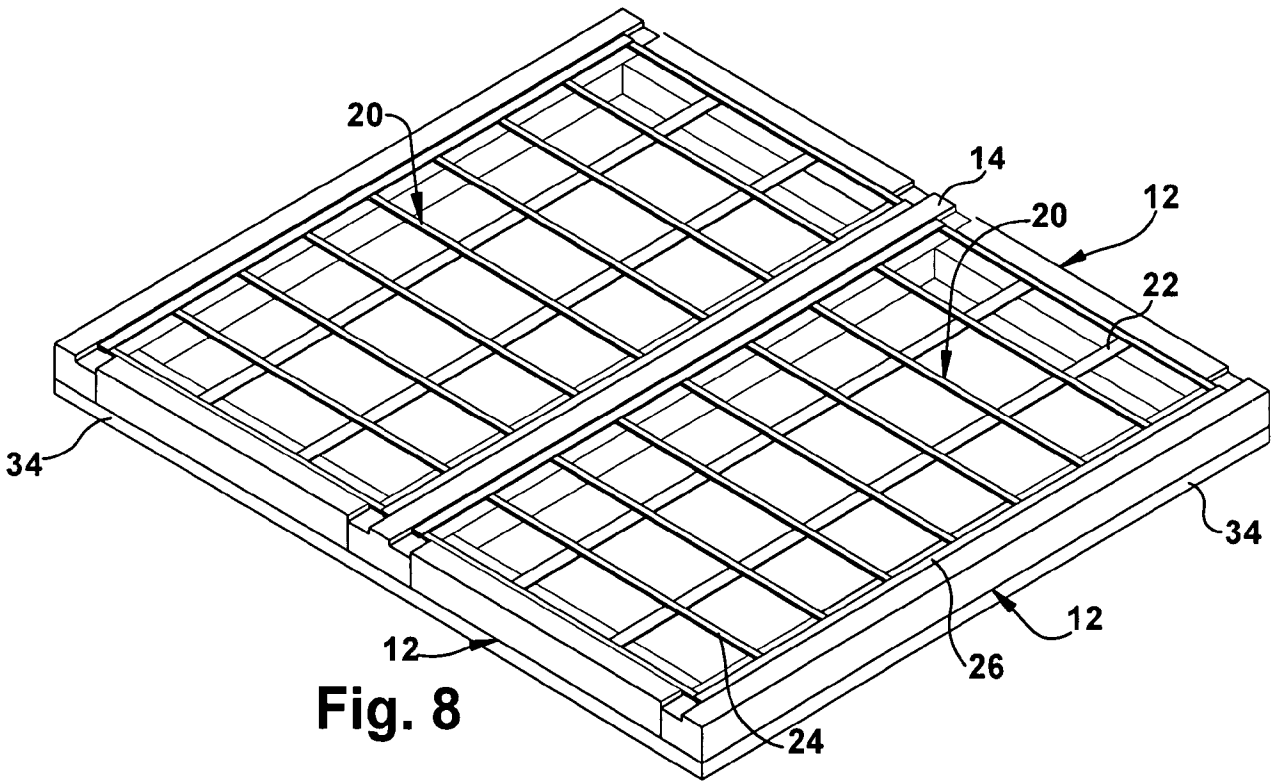
FIG. 8 is a perspective view of a side-by-side version of a suspended flexible matrix support system.

FIGS. 7 and 8 illustrate a still further embodiment of a suspended flexible matrix support system which includes two flexible matrices 20 arranged side-by-side within cooperating frame members 12, and with a central frame member 14 disposed between the matrices 20. Each of the matrices 20 and corresponding frame members 12 are positioned over and attached to an underlying foam deck 34, which can be a single piece or two or more pieces. As previously described, the foam deck 34 may cover the entire expanse beneath the flexible matrices, or alternatively, underlie on the frame members 12 Stiffening elements or materials may be incorporated in the frame members 12 and/or the foam deck 34. This side-by-side embodiment is particularly well suited for use as a queen or king size foundation or mattress. Other sizes of support systems can be constructed with internal cross frame members such as frame member 14, and additional flexible matrices 20 which fit within subdivisions of an outer perimeter frame.

The invention claimed is:

1. A flexible support system comprising:

a frame formed by four frame members arranged in a rectangular arrangement, the four frame members having a generally rectangular cross-section with a bottom surface and a top surface, an outer vertical side surface that extends between the bottom surface and the top surface, a horizontal shelf located in an upper region of the frame member, proximate to the top surface, a first inner vertical side member that extends between the bottom surface and the horizontal shelf, and a second inner vertical side member that extends between the horizontal shelf and the top surface;

a flexible matrix comprised of a plurality of intersecting longitudinal and transverse flexible members and at least one channel arranged perpendicular to and engaged with the terminal ends of the transverse flexible members; and a perimeter of the flexible matrix supported by the shelf of the frame at an elevation above the bottom surface of the frame, wherein the frame members of the frame are made of extruded, molded or sculpted foam and the flexible members of the flexible matrix are made of a fiber-reinforced composite material.

2. The flexible support system of claim 1, wherein a perimeter of the flexible matrix is supported by the shelf of the frame members, and a top surface of the frame members is substantially flush with a top of the flexible matrix.

3. The flexible support system of claim 1, wherein the frame is at least partially compressible in response to a load applied to the frame or to the flexible matrix.

4. The flexible support system of claim 1, wherein the flexible matrix is comprised of flexible members of at least two different configurations.

5. The flexible support system of claim 1, wherein the flexible members of the flexible matrix comprise a first group of parallel flexible members and a second group of parallel flexible members which intersect the first group at right angles.

6. The flexible support system of claim 1, wherein a first group of flexible members of the flexible matrix underlies a second group of flexible members of the flexible matrix.

7. The flexible support system of claim 1, wherein a leg of the channel is engaged in a detent in the flexible members.

8. The flexible support system of claim 1, wherein the flexible matrix is comprised of flexible members wherein the longitudinal members have different flex modulus values than the transverse members.

9. The flexible support system of claim 1 further comprising at least one additional support component located beneath the flexible matrix and within the frame.

10. The flexible support system of claim 1, wherein a first group of flexible members of the flexible matrix have a first cross-sectional configuration, and a second group of flexible members of the flexible matrix have a second cross-sectional configuration which is different than the first cross-sectional configuration of the first group of flexible members.

11. The flexible support system of claim 1, wherein the flexible members of the flexible matrix are attached together at areas of intersection.

12. A flexible support system comprising:

a flexible matrix comprised of a plurality of intersecting transverse and longitudinal flexible members, terminal ends of the transverse flexible members engaged in channels which are arranged perpendicular to the terminal ends of the transverse flexible members and define a rectangular perimeter to the flexible matrix;

a frame defined by four foam frame members, each of the four foam frame members consisting of one solid piece of foam having a top surface and a bottom surface, an outer vertical side surface which extends between the top surface and the bottom surface, a shelf located in an upper region of the frame member proximate to the top surface, a first inner vertical side which extends between the bottom surface and the shelf and a second inner vertical side which extends between the shelf and the top surface;

the perimeter of the flexible matrix positioned on the shelf of the foam frame members.

13. The flexible support system of claim 12 further comprising a foam deck positioned beneath the bottom surface of the foam frame members.

14. The flexible support system of claim 12 further comprising at least one internal component underneath the flexible matrix and within the foam frame members.

15. The flexible support system of claim 12 in combination with upholstery which encapsulates the flexible matrix and the foam frame members.

16. A flexible support system comprising:

a frame formed by intersecting frame members, each of the frame members having a bottom surface, a top surface and vertical surfaces which extend between the bottom surface and the top surface, one of the vertical surfaces forming an outer perimeter of the frame and a flexible support system;

two flexible matrices arranged side-by-side and a central frame member positioned between the two flexible matrices, each a flexible matrix formed by intersecting flexible members which extend from one frame member to another frame member and within the outer perimeter of the frame, and ends of the flexible members supported by the top surfaces of the frame members, wherein the frame is made of foam and the flexible members of the flexible matrix are made of at least one plastic material and at least one reinforcement material.

17. The flexible support system of claim 16, wherein the top surfaces of the frame members include a shelf which supports the ends of the flexible members.

18. The flexible support system of claim 16, wherein at least some of the flexible frame members having a generally rectangular cross-sectional configuration.

19. The flexible support system of claim 16, wherein the terminal ends of at least some of the flexible members of the flexible matrix are received within a channel arranged perpendicular to the terminal ends of the flexible members which is also supported by the top surfaces of the frame members.

20. The flexible support system of claim 16, wherein the flexible members of the flexible matrix extend in at least two different directions within the frame and intersect at substantially right angles.

21. The flexible support system of claim 16, wherein flexible members of the flexible matrix are connected together at areas of intersection.

22. The flexible support system of claim 16, wherein the longitudinal members of the flexible matrix have different degrees of flexibility than the transverse members of the flexible matrix.

23. The flexible support system of claim 16, wherein the frame members of the frame are compressible and resilient.

24. The flexible support system of claim 16 further comprising a foam deck positioned proximate to bottom surfaces of the frame members.

25. The flexible support system of claim 16 in combination with at least one layer of material which extends over the flexible matrix.

26. The flexible support system of claim 16, wherein the frame members have a generally rectangular cross-sectional configuration.

* * * * *